United States Patent [19]

Riley et al.

[11] Patent Number: 4,953,996

[45] Date of Patent: Sep. 4, 1990

[54] PRINTWHEEL SETTING DEVICE FOR A POSTAGE METER

[75] Inventors: Gilbert N. Riley, Wilton; Richard S. Holodnak, Stratford; Richard A. Malin; Arno Muller, both of Westport, Conn.

[73] Assignee: Pitney Bowes Inc., Stamford, Conn.

[21] Appl. No.: 376,175

[22] Filed: Jul. 6, 1989

Related U.S. Application Data

[63] Continuation of Ser. No. 114,358, Oct. 27, 1987, abandoned.

[51] Int. Cl.[5] ..... B41J 1/34

[52] U.S. Cl. ..... 400/162.2; 101/91

[58] Field of Search ..... 101/91; 400/154.3, 162.2, 400/144.2, 162.3

[56] References Cited

U.S. PATENT DOCUMENTS

| | | | |
|---|---|---|---|
| 3,399,753 | 9/1968 | Revelle | 400/162.2 |
| 3,816,656 | 6/1974 | Ludwig | 400/154.3 |
| 4,053,043 | 10/1977 | Deetz | 400/144.2 |
| 4,118,129 | 10/1978 | Grundherr | 400/144.2 |
| 4,311,398 | 1/1982 | Gerjets | 400/144.2 |
| 4,367,676 | 1/1983 | Clark | 101/91 |
| 4,398,458 | 8/1983 | Denzin et al. | 101/91 |

FOREIGN PATENT DOCUMENTS

| | | | |
|---|---|---|---|
| 537245 | 12/1976 | U.S.S.R. | 400/163 |

*Primary Examiner*—Eugene H. Eickholt

*Attorney, Agent, or Firm*—Michael J. DeSha; David E. Pitchenik; Melvin J. Scolnick

[57] ABSTRACT

A postage meter includes a printwheel setting mechanism which allows shortest path setting of the printwheel. Stepper motors are provided for each printwheel which drives the printwheels through a transfer gear having a large diameter and greater number of teeth so that there are multiple positions of the transfer wheel which correspond to a particular character to be printed by the printwheel. The stepper motors are microprocessor controlled and a routine calculates the shortest rotational path of the setting of a new character for printing.

10 Claims, 21 Drawing Sheets

TIMER INTERRUPT ROUTINE

INITIALIZATION

PRINTWHEEL SETTING DEVICE FOR A POSTAGE METER

This application is a continuation, of application Ser. No. 114,358, filed 10/27/87 and now abandoned.

RELATED APPLICATIONS

Other applications which describe and claim related subject matter are:

App. Ser. No. 114,363 entitled A REMOVABLE POSTAGE METER HAVING AN INDICIA COVER, filed 10-27-87 and now U.S. Pat. No. 4876956 and assigned to Pitney Bowes; and App. Ser. No. 114,361 entitled DIE PROTECTION ASSEMBLY FOR PREVENTING FRAUDULENT PRINTING BY AN ELECTRONIC POSTAGE METER filed on 10-27-87 herewith and assigned to Pitney Bowes and now abandoned.

FIELD OF THE INVENTION

The invention relates to electronic postage meters and more particularly to so-called flat-bed printing meters.

BACKGROUND OF THE INVENTION

Electronic meters of the flat-bed printer type are well-known and are described for example in U.S. Pat. No. 4,579,054, issued to Buan, et al., which shows a stand-alone electronic mailing machine in which the electronic postage meter forms an integral part of the device. Aspects of such a stand-alone mailing machine are described in U.S. Pat. Nos. 4,535,407 and 4,523,523 among others.

Of particular concern in postage meters and mailing machines developed for high throughput is the speed with which the printwheels can be set to a new value. U.S. Pat. No. 4,034,669 teaches the use of a separate stepper motor for each printwheel in the printdrum of a postage meter of the rotary press type. U.S. Pat. No. 4,398,458 shows a setting device for the printwheels in a print drum in which separate stepper motors are used for each printwheel. U.S. Pat. No. 4,541,053 describes a method for the parallel setting of printwheels using a particular drive arrangement for the stepper motors. While the devices shown in these patents provide additional economy and speed because they operate in parallel, the printwheels are set by racks and a pinion and must be set only when the drum is in a predetermined position.

U.S. Pat. No. 4,367,676 issued to Clark discloses a selection mechanism for a rotary print drum meter which may be used when the drum is at rest or in motion. One embodiment is shown in which separate motors are used to drive each setting wheel. It is suggested therein that the arrangement allows for shortest path setting. U.S. Pat. Nos. 4,608,923 and 4,658,722 issued to Muller show other printwheel setting devices for rotary drum printing postage meters. The devices described therein are operated for the sequential setting of each printwheel. The use of absolute encoding taught therein allows the elimination of any stops on the gears to enable shortest path setting.

While each of these devices may work well in its intended manner, each is not suitable for operation in a flat bed letter press postage meter. Only Clark teaches setting during movement of the printdrum and the setting mechanism requires a complex gearing arrangement to enable rotation of the drum while maintaining the printwheels fixed.

SUMMARY OF THE INVENTION

The electronic meter in accordance with the invention is a flat-bed letter press printing postage meter which is removable from the mailing machine and in which there is included a novel printwheel setting mechanism suitable for such a flat-bed printer. Each printwheel setting mechanism comprises a gear train which includes the printwheel (value wheel), a transfer gear, an encoder system, a pinion and a motor for driving the gear train.

In a preferred embodiment, each transfer gear has thirty teeth about its circumference which mesh with a ten-tooth gear coupled to the printwheel. In accordance with the invention, the printwheel can thus make almost three complete revolutions for one revolution of the transfer wheel. The microprocessor program for setting the printwheels favors the mid-range position of the transfer gear. A stop is provided for the transfer gear so that there is a zero-reference position. When the transfer gear is adjacent to this stop there is a known fixed postage value on the printing plane of the meter print die.

The encoder in the preferred embodiment includes a ten-tooth gear that meshes with the transfer gear, a twenty-tooth that meshes with the motor pinion and an encoder wheel having projections thereon for blocking radiation from the source to the detector of a sensor channel. Preferably the encoder wheels pass through a two-channel sensor assembly to produce twenty transitions per revolution to result in two sensed transitions (one for each channel) for each move of one digit. The encoder transitions are used to determine the printwheel position.

Preferably, the two channels are physically separated such that when the encoder wheel is rotated through the sensor assembly, the resulting detector outputs are in phase quadrature (that is, the output of one of the two channel detectors leads or lags the output of the other by one quarter of a cycle).

The setting mechanism in accordance with the invention will be described in conjunction with a novel flat bed printing type of postage meter but it will be understood that it could be incorporated in other conventional postage meters in place of the printwheel setting mechanisms described therein.

DETAILED DESCRIPTION OF THE DRAWINGS

Figure 1:
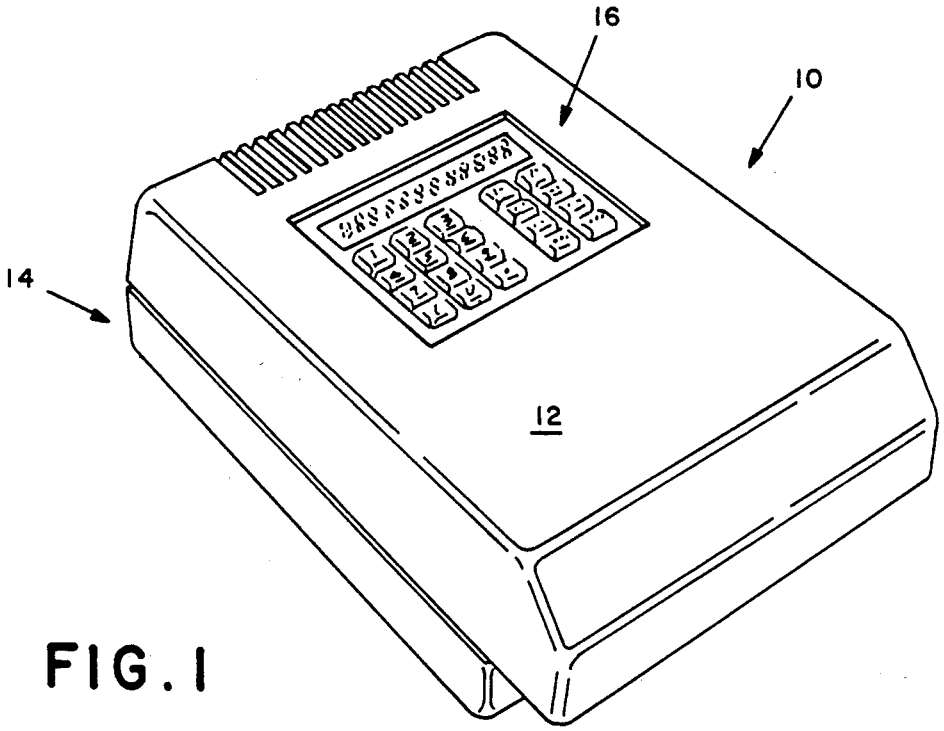
FIG. 1 is an external perspective view of an electronic meter in accordance with the invention.

In FIG. 1 there is shown at 10 an electronic meter in accordance with the invention. The cover 12 of the housing 14 holds a keyboard and display 16. The keyboard and display are suitably similar to that shown in U.S. Pat. No. 4,097,923 specifically incorporated herein by reference. Preferably, the keyboard is of conventional monolithic type and the display is liquid crystal with a capacity of twelve digits. It will be understood that the meter keys and display of registers are not necessarily limited to those shown in this reference and may be varied as desired in accordance with the requirements of the meter. When the meter 10 is installed on a mailing machine, the keyboard and display may be hidden from view of the operator.

Figure 2A:
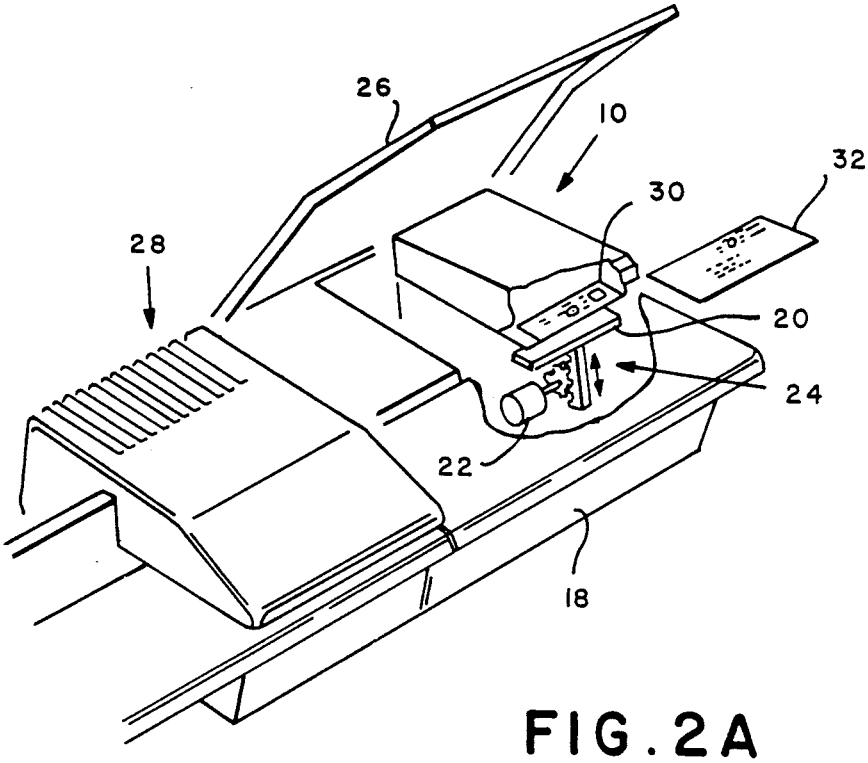
FIG. 2A is a perspective view of a meter in accordance with the invention shown in position on a mailing machine.

FIG. 2A is a perspective view of the meter 10 installed in a mailing machine or meter base 18. The mailing machine 18 has schematically shown therein a printing platen 20 reciprocally driven by motor 22 through rack and pinion mechanism 24. Lid 26 when closed during normal operation will cover the meter. Feeder module 28 feeds mailpieces to the base 18 which transports the mailpiece to the space between the print die 30 of the meter which carries the meter indicia and the platen 20, whereupon with upward reciprocation of the platen, an imprint of the indicia is placed upon a mailpiece such as mailpiece 32 shown being ejected from the mailing machine.

Platen drive arrangements are well known and are shown for example in U.S. Pat. No. 4,579,054 to Buan et al. and in U.S. Pat. No. 2,795,186 to Bach et al. It should be appreciated however that in respect of the meter in accordance with the invention the platen 20 is a part of the base 18 and the meter 10 includes only the print die 30. The mailing machine will not be further described except as necessary for the discussion of the operation of the meter 10.

In the preferred embodiment the print die is an elastomer print die in order to obtain the best print quality for a given platen force. It will also be appreciated that as is well known, the print die must be inked in order to print the indicia. Inking mechanisms are known and are also shown in the previously cited patents of Buan and Bach. Preferably the inker mechanism (which is not shown) also remains with the base 18. It will be understood that the inker could be a part of the meter instead.

Figure 2B:
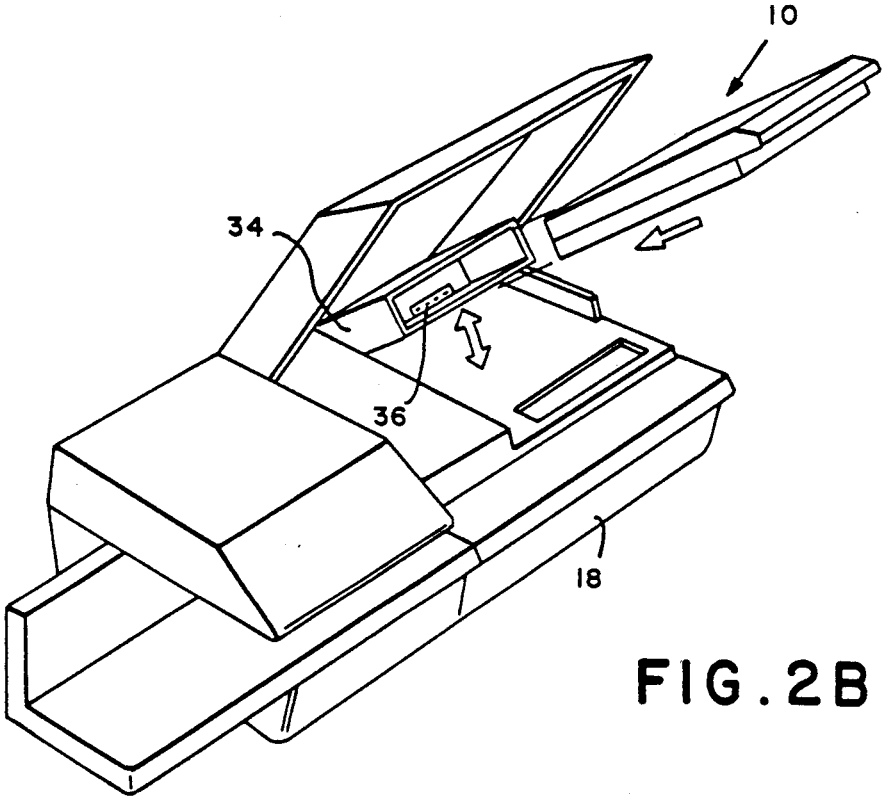
FIG. 2B shows one way of removing a meter in accordance with the invention from the mailing machine.

FIG. 2B shows the meter being removably mounted on the base 18. The meter is inserted into pocket 34 which is pivotally mounted to the base 18. When the meter is inserted into the pocket 34 connector 36 in the pocket mates with a corresponding connector 38 (not shown in FIG. 2B) on the meter 10.

The mating connectors 36 and 38 serve to enable communication between the mailing machine 18 and the meter 10 and preferably carry power to the meter as well. A suitable communication system is described in U.S. Pat. No. 4,301,507 issued to Soderberg et al., specifically incorporated herein by reference. The communication between the units as described in this patent is serial character asynchronous, bit synchronous, in message form, with the bits of the messages being timed in accordance with a given schedule for synchronous control. It will be understood that other communication procedures and devices well-known in the art may be used in the alternative if desired.

Figure 3:
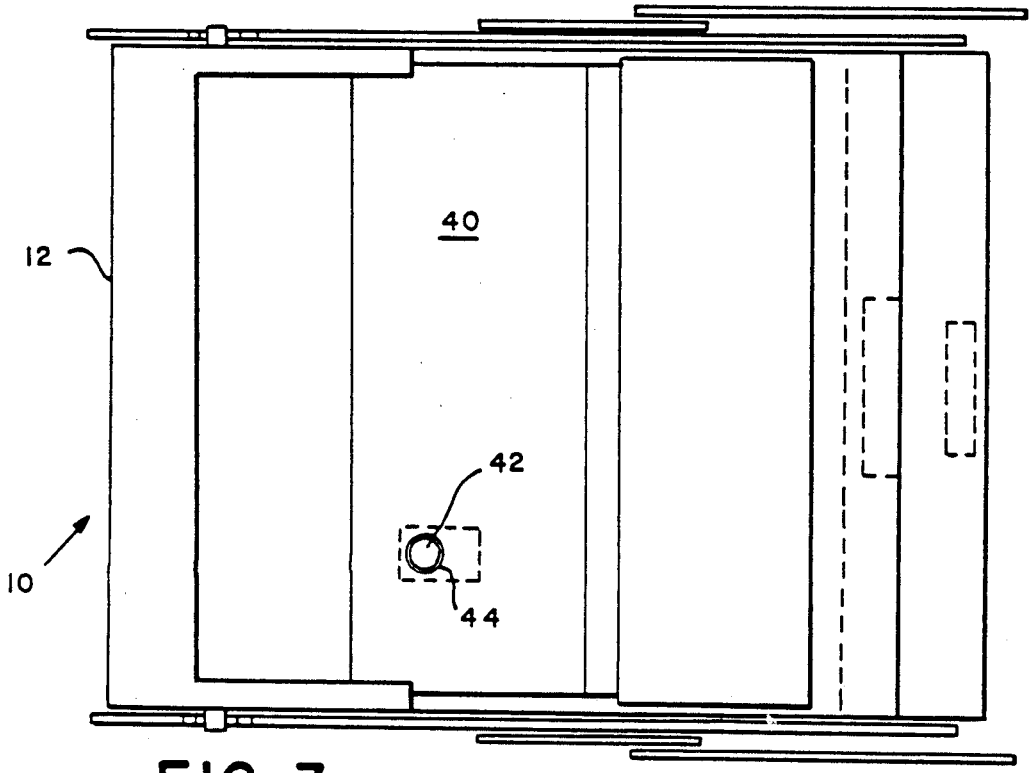
FIG. 3 is a bottom view of the meter which shows the sliding shutter that covers the die when the meter is removed from the mailing machine.

Turning now to FIG. 3 which shows a bottom view of the meter, a sliding plate or shutter 40 is slidingly mounted on housing 12 and is locked in the illustrated closed position suitably by means of dead bolt 42, preferably spring-loaded, which extends into the hole 44 of shutter 40. The shutter is released by actuation of solenoid 46 (seen in the illustrated embodiment of FIG. 4A and 4B) but it will be understood that means such as a cam-actuated, motor-controlled locking mechanism may be used in the alternative or in addition to such solenoid-actuated deadbolt if desired.

Figure 4A:
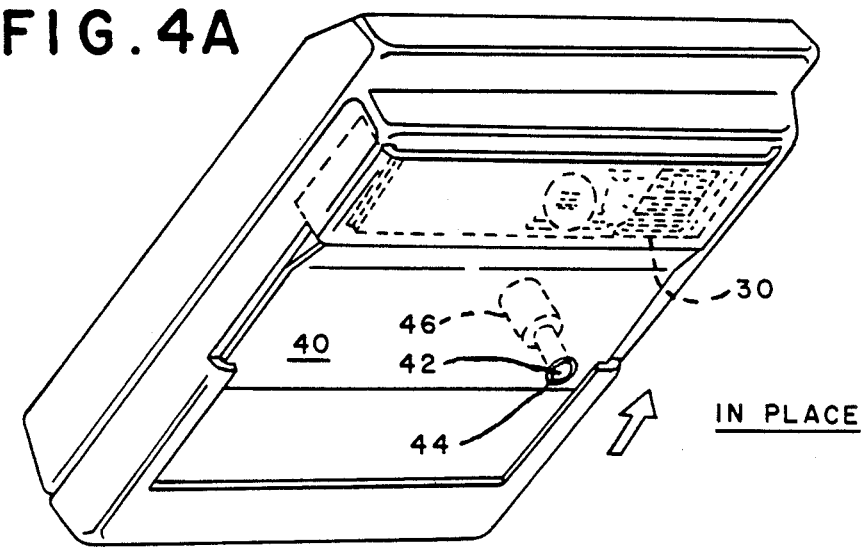
FIG. 4A is a perspective view showing the print die and solenoid-operated dead bolt with the sliding shutter in the closed position. Other meter internal assemblies except for the die are not shown for ease of viewing.
Figure 4B:
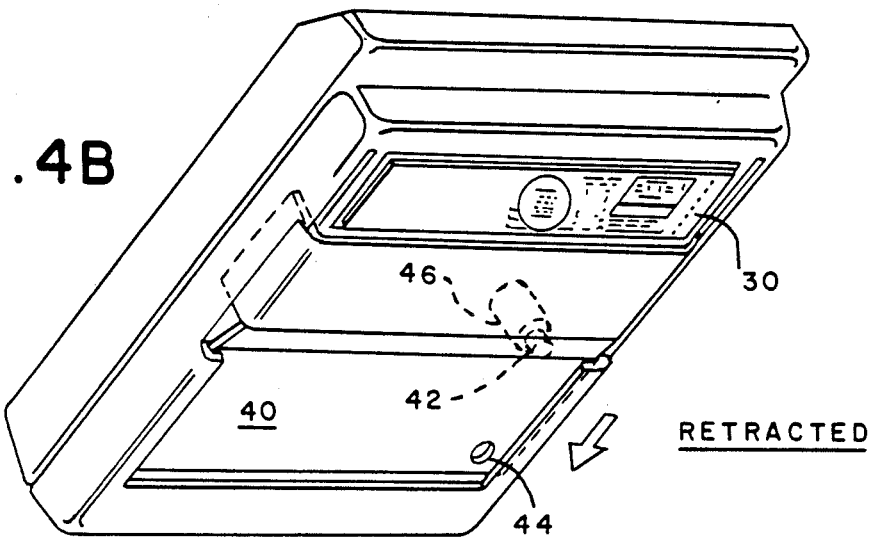
FIG. 4B is a similar perspective view of the meter as in FIG. 4A showing the sliding shutter in its retracted position.

FIGS. 4A and 4B show perspective views of the meter with the shutter 40 shown covering the print die 30 and in the retracted position with the print die exposed.

In order to prevent access to deadbolt 42 from the outside, it will be understood that hole 44 may be a blind hole or bore on the inside of the shutter 40.

As previously noted, the meter in accordance with the invention is a flat bed printer with elastomer printing dies and that the platen and inking mechanism preferably remain with the mailing machine. In order to protect the print die in this configuration, whenever the meter is removed from the mailing machine, in accordance with the invention all of the printing elements are automatically covered by the shutter 40. This shutter which covers the die is only retracted as discussed below when the meter is in place on a legitimate mailing machine. The die cover or shutter 40 is one of three independent die protection mechanisms in this meter.

It should thus be appreciated that the die would still be protected from the "wiping" or fraudulent taking of prints by the other protection mechanisms. Exposure of the print die 30 however might still allow tampering to alter some of the artwork of the indicia or allow damage to occur or to expose the operator to ink from the die.

Figure 5:
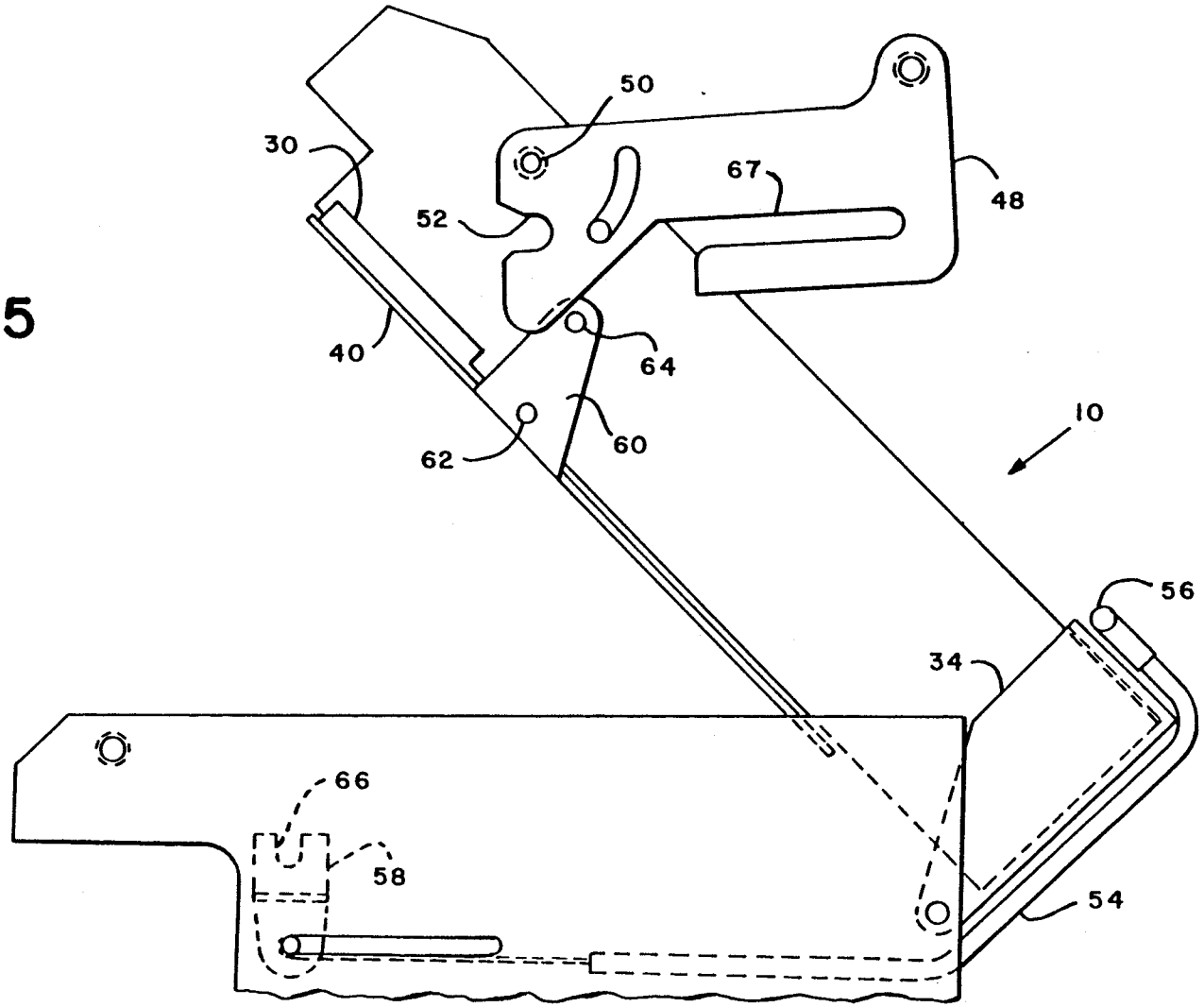
FIG. 5 is a side view of a first embodiment of an operate-remove mechanism for attachment of the meter to the mailing machine.

FIG. 5 is a side view of one embodiment of an operate-remove mechanism for the meter. Carry handle 48 (not shown in previous Figures) is pivotally mounted on meter 10 at pin 50. Slot 52 on the handle is operative to engage a mating pin (not shown) on the base 18 when the meter is pivoted downward as illustrated in FIG. 5 and the handle 48 is rotated in the clockwise direction. It will be understood that at this juncture the meter 10 is electrically connected to the meter base 18 through mating connectors 36 and 38 and is locked to the base by slot 52 engaging with the mating pin on the base.

With the meter and base operative, communication is established and using appropriate "handshake" messages between the meter and the base it is determined that a proper meter is in the home position on a legitimate base. Accordingly, deadbolt 42 (not shown in FIG. 5) is retracted, preferably only for a predetermined length of time. With the deadbolt retracted, the shutter 40 may be moved rearward (to the right in FIG. 5). In the illustrated embodiment, this is accomplished by means of the flexible cable 54 having handle 56 for grasping by the operator. The cable is suitably mounted on the pocket 34 by any convenient means (not shown). The other end of the cable is connected to pull slide 58 slideably mounted on the base 18 by any convenient means (also not shown). The side wall 60 carries pin 62 and pin 64. With the meter in the home position, that is in the lower position illustrated, pin 62 engages slot 66 of slide pull 58. When the slide pull 58 is moved by the operator pulling forward on the flexible cable, the shutter 40 will also be retracted to uncover the print die shown at 30.

As shutter 40 moves, pin 64 will interlock with slot 66 of the carry handle 48 to prevent the meter from being lifted from the operating position when the shutter is retracted. Thus in order to remove the meter 10, The operator must push the flexible cable inward to push the shutter 40 into position again covering the print die 30. The deadbolt 42 is spring-loaded and re-engages the hole 42 in the shutter to lock the shutter in secure position.

Figure 6:
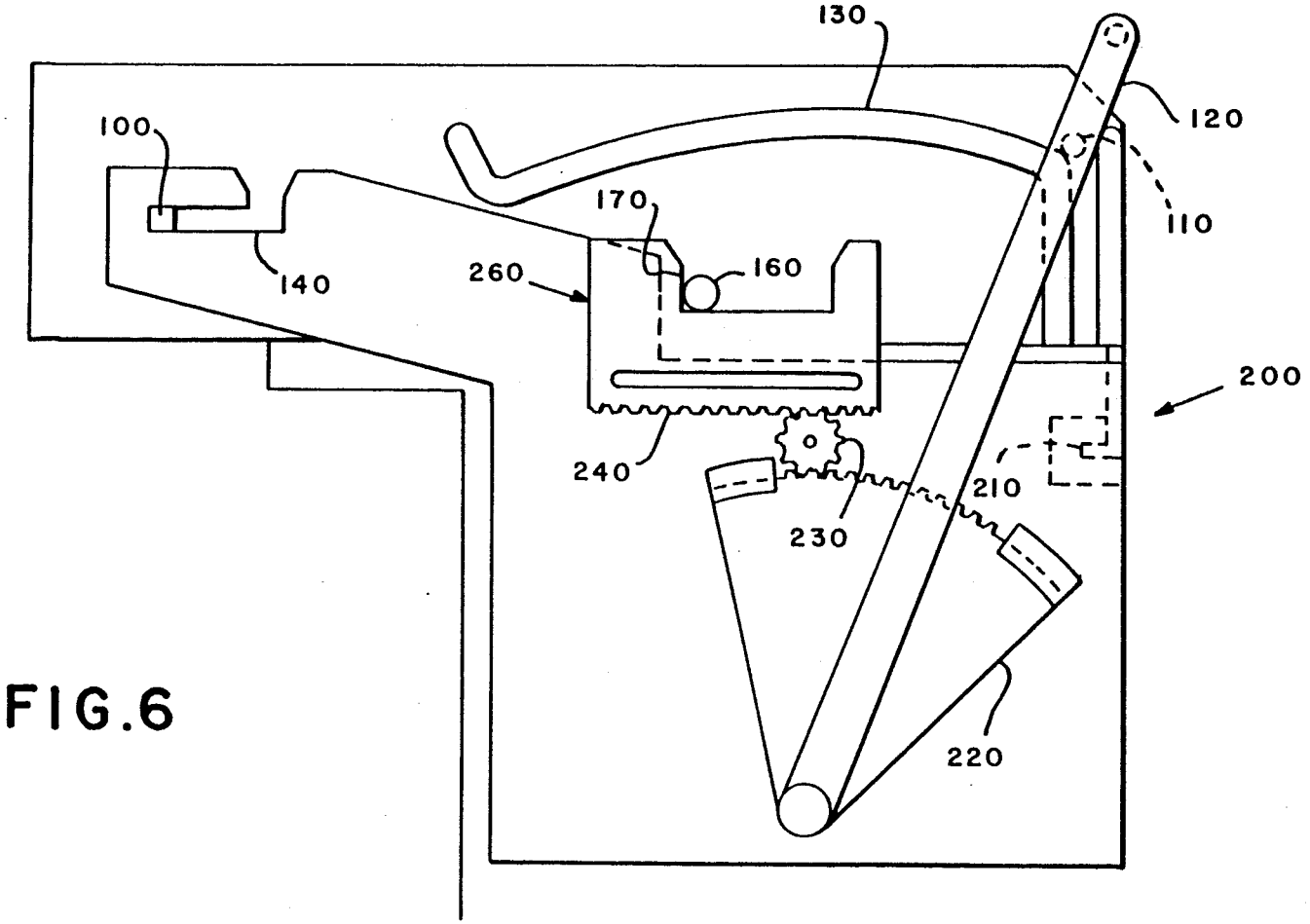
FIG. 6 is a side view of an alternative embodiment of an operate-remove mechanism.

Other methods and apparatus may be used for the purpose of retracting the shutter. FIG. 6 shows an alternative embodiment where the meter is installed by lowering it vertically into the base. In FIG. 6 the mechanism is shown in mid-position after the meter has been installed and locked in position but prior to the retraction of the shutter mechanism.

The meter shown in this embodiment is placed vertically downward on the base with square pin 100 on the meter being to the front of the meter and pin 110 on handle 120 clear for up and down movement of the meter from the base. The cam surface 130 on the meter captures the pin 110 and as the lever is pulled by the operator toward the front of the meter the vertical slot portion of the cam surface 130 is pushed toward the operator so that pin 100 is engaged in slot 140. At this point the meter is locked in place and communication between the meter and the base is established as described in connection with FIG. 5. With the appropriate "handshake" the deadbolt is raised to allow further movement of the handle. Pin 160 which is mounted on the shutter has also moved into contact with wall 170. Preferably, a lip or angled member shown at 200 also engages a slot 210 to lock the meter to the base.

As the handle 120 moves further forward, sector 220 engages pinion 230 which drives rack 240 affixed to member 260 that carries wall 170. The shutter plate is moved rearwardly by action of wall 170 on pin 160 until the handle is stopped by the cam surface 130 and the shutter has exposed the print die.

Other means for locking the meter in place and for actuating the retraction of the shutter can be envisioned depending in part on the way the meter is required to be installed. It will be understood that the various operations performed by the operator for retracting the shutter can be motorized if desired.

Figure 7:
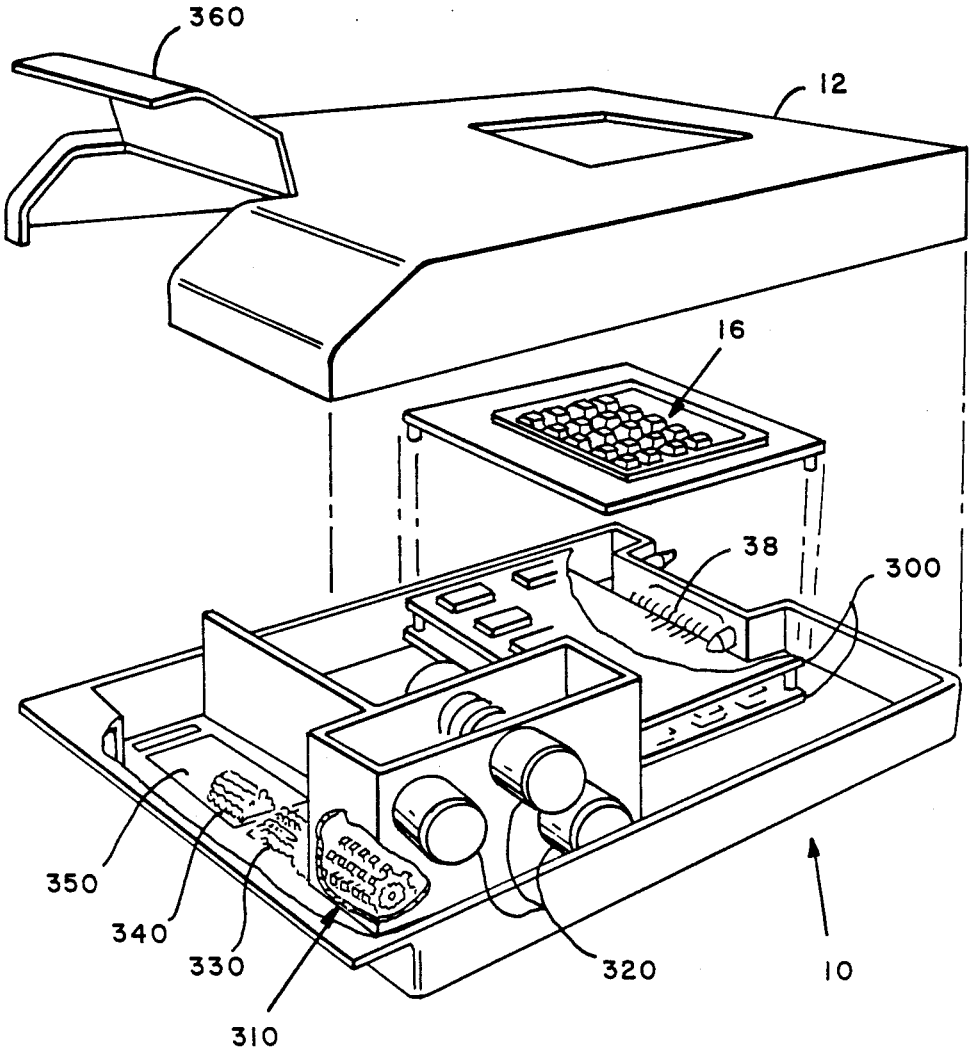
FIG. 7 is a partially exploded view of a suitable internal configuration of the meter in accordance with the invention.

FIG. 7 shows a partially exploded view of a meter in accordance with the invention. The meter 10 is shown with the cover 12 and keyboard and display raised from the bottom to expose a schematic layout of the meter hardware. The connector 38 feeds into the printed circuit boards 300 which comprise the accounting and printing control functions described below. The print wheels 310 are set by stepping motors 320 in an arrangement also described below. A dater assembly 330, PIN counter 340 and a slogan printer 350 are also provided as required. Preferably, a door 360 provides access as necessary to the slogan, PIN, and date printers.

Figure 8:
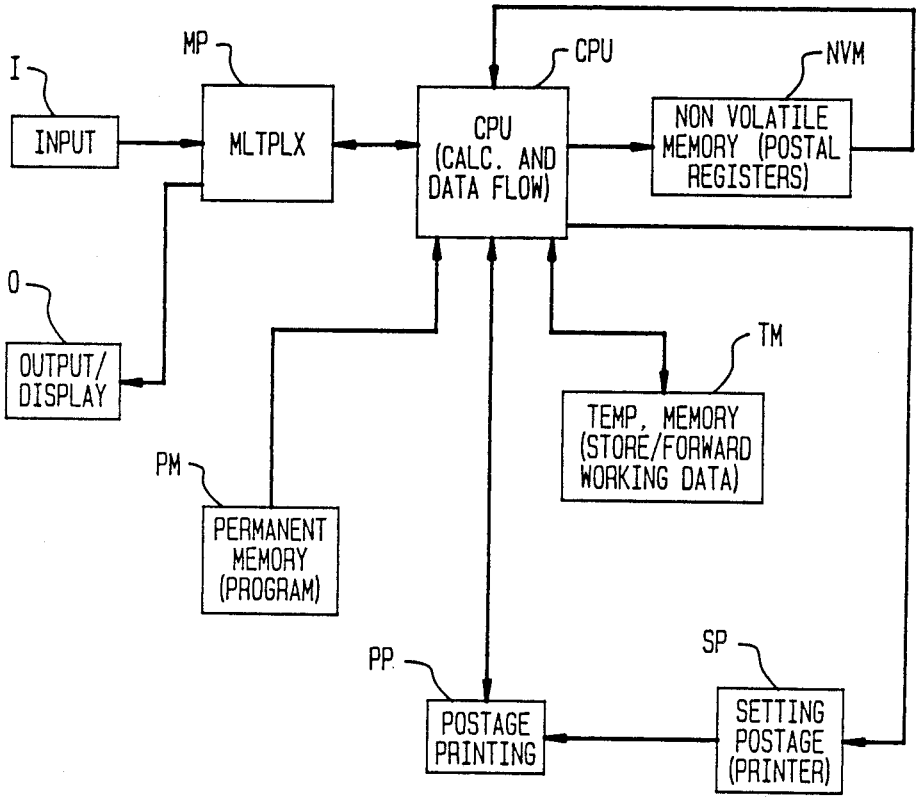
FIG. 8 is a functional block diagram of a computerized postage meter.

FIG. 8 is a functional block diagram of a computerized postage meter. The system is controlled by a microprocessor which basically comprises a CPU which performs the functions of accounting, controlling the setting of the printwheels, die protection and the communication with the base and other peripherals as required. Three types of memory units are employed with the CPU. The permanent memory PM which may be a ROM or PROM stores the sequence of program operations to be performed by the CPU for its accounting calculations and control functions. The temporary memory TM which is a working RAM holds the data and calculation results on a temporary basis until they are stored in the non volatile memory NVM. The non volatile memory can be battery-backed RAM, EEPROM, EAROM, or MNOS as desired or any combination if two or more memories are utilized. Preferably, at least two nonvolatile memories are used and transaction accounting data is stored in nonvolatile memory for each transaction. A suitable method for such accounting is shown in U.S. Pat. No. 4,484,307. Other accounting methods are described in U.S. Pat. No. 3,978,457. Funds may also be placed in or removed from such memories by means as described in U.S. Pat. No. 4,097,923 specifically incorporated herein by reference.

Figure 9:
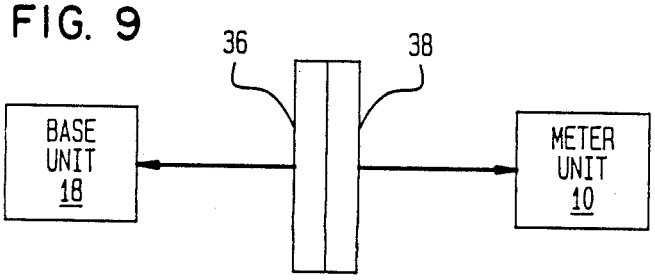
FIG. 9 is a block diagram showing communication between the mailing machine and the postage meter.

The system in accordance with the invention may operate in accordance with data input through the keyboard and display 16 and display information on the same. Preferably, however, the meter receives and transmits information to the mailing machine or other peripheral through connector 38 as shown in FIG. 9. The meter keyboard and display in this arrangement would be useable only for the purpose of reading the various meter registers and/or for the purpose of refunding the meter and for various checks and accounting operations which may be required when the meter is not installed on its base. The CPU in accordance with the data it receives operates the stepping motors 320 for setting the printwheels 310 shown in this Figure as the setting postage block SP and also controls the other die protector devices to allow the printing of postage to take place. This is indicated at the postage printing block PP.

FIG. 9 shows a block diagram of the communication between the meter and mailing machine. As mentioned previously it is preferred that all the communication be by way of the protocol described in U.S. Pat. No. 4,301,507.

Figure 10:
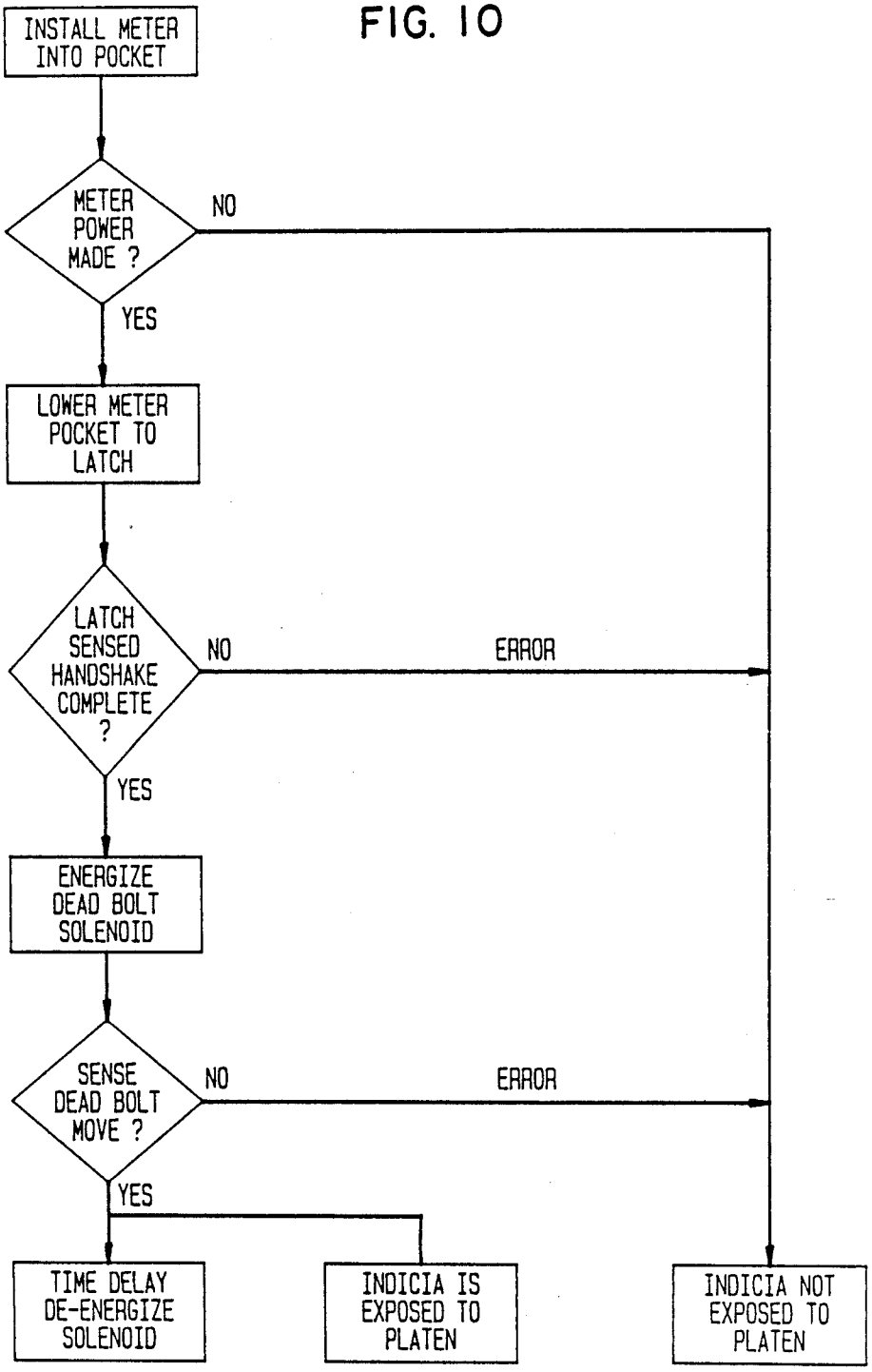
FIG. 10 is a flow chart of a suitable communication routine for releasing the dead bolt to allow retraction of the sliding plate.
Figure 11:
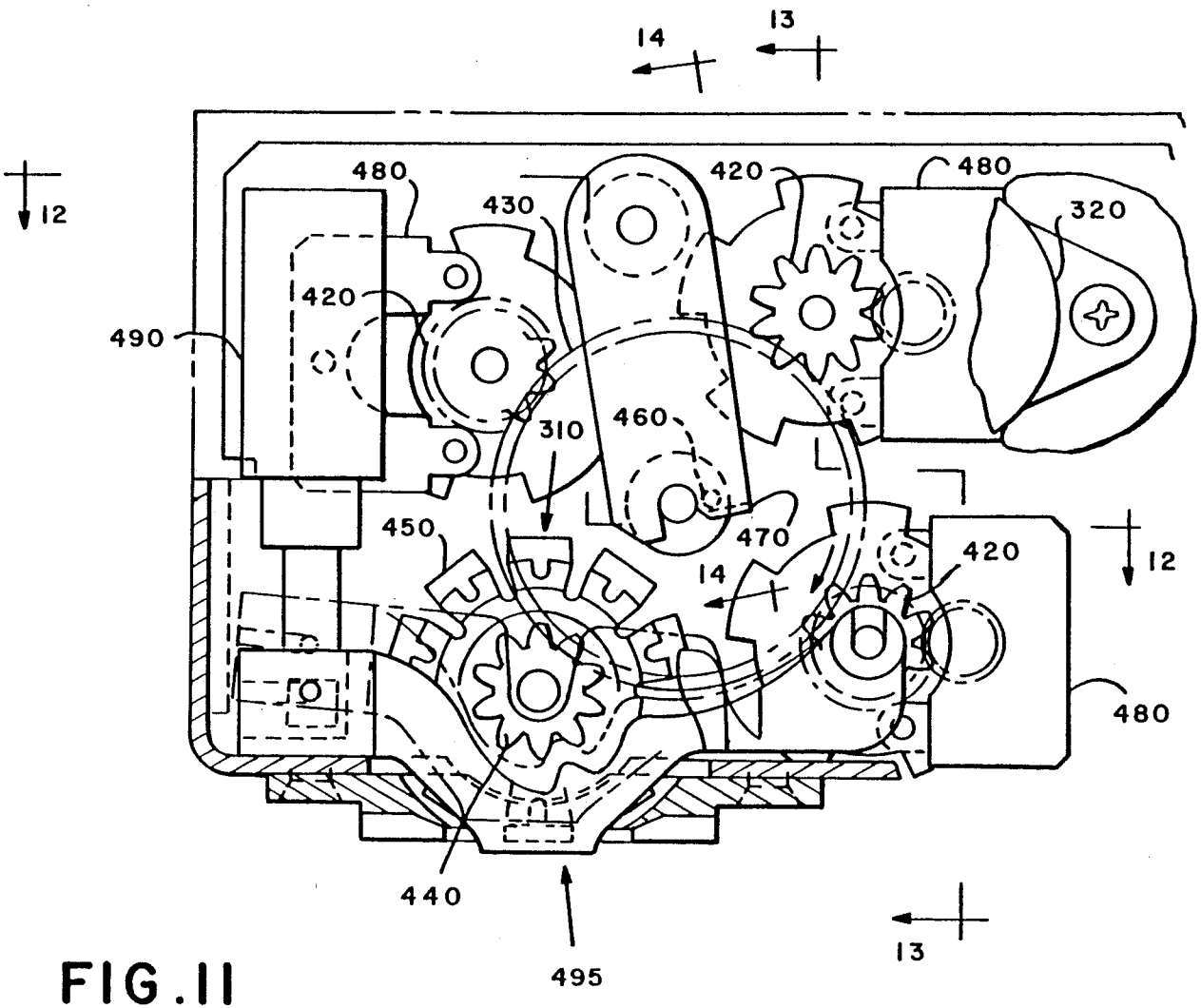
FIG. 11 is a side view of the printwheel setting mechanism in the postage meter.
Figure 12:
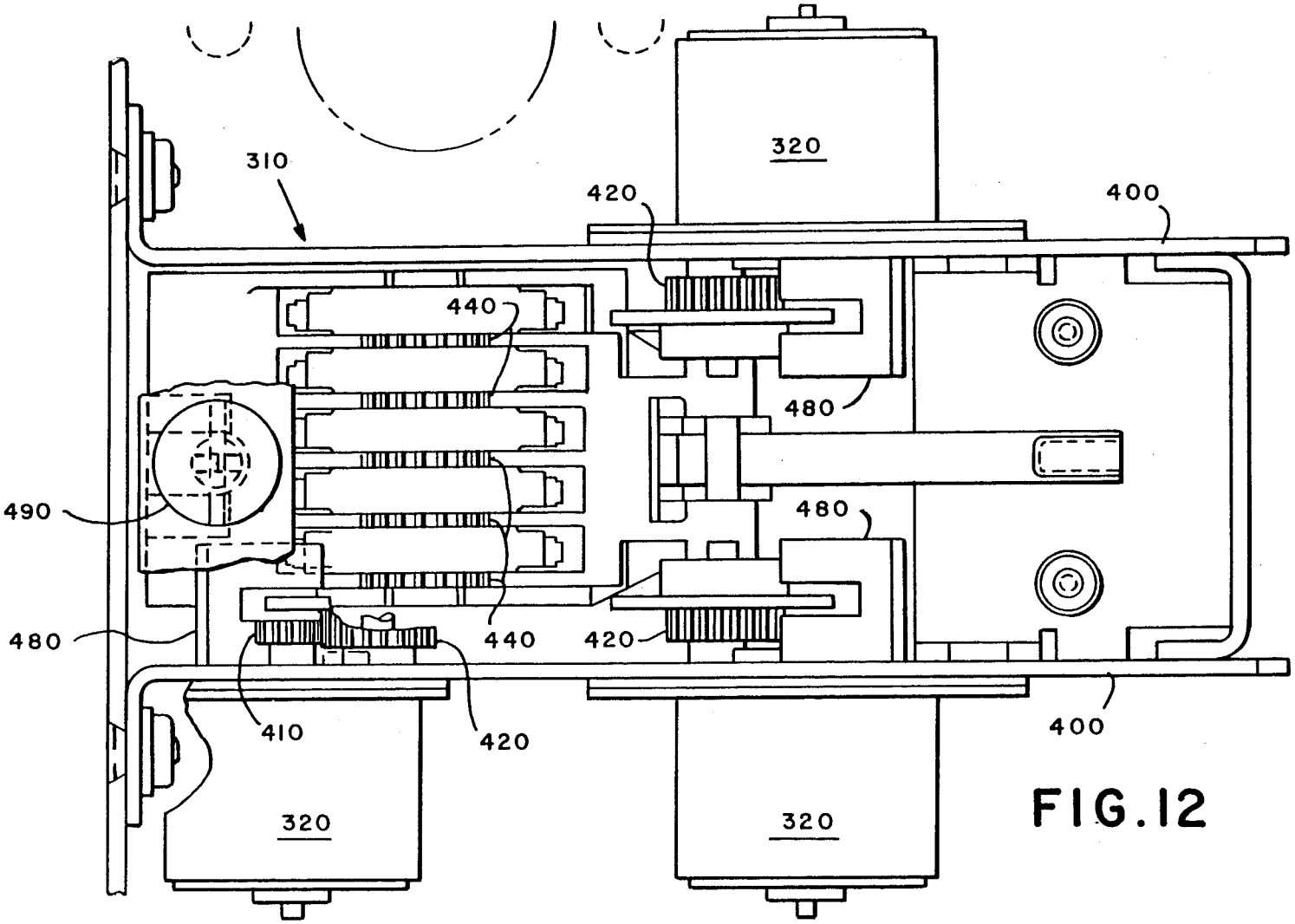
FIG. 12 is a section taken along the line 12—12 of FIG. 11.
Figure 13:
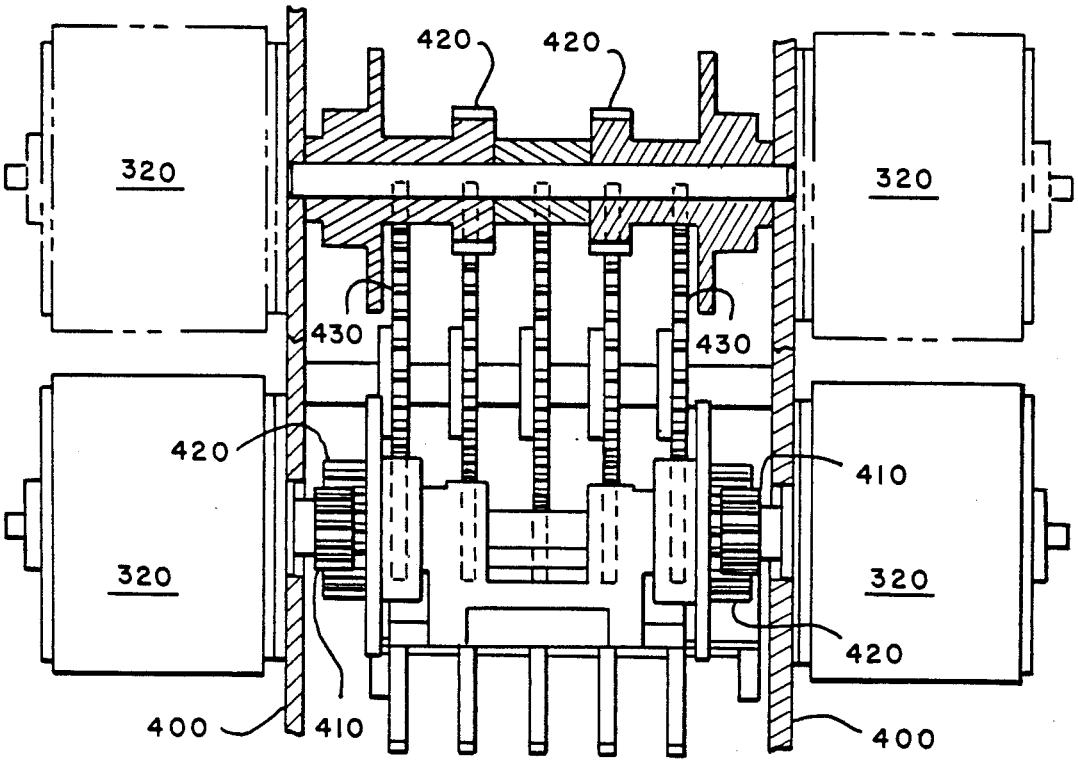
FIG. 13 is a section taken along the line 13—13 of FIG. 11.
Figure 14:
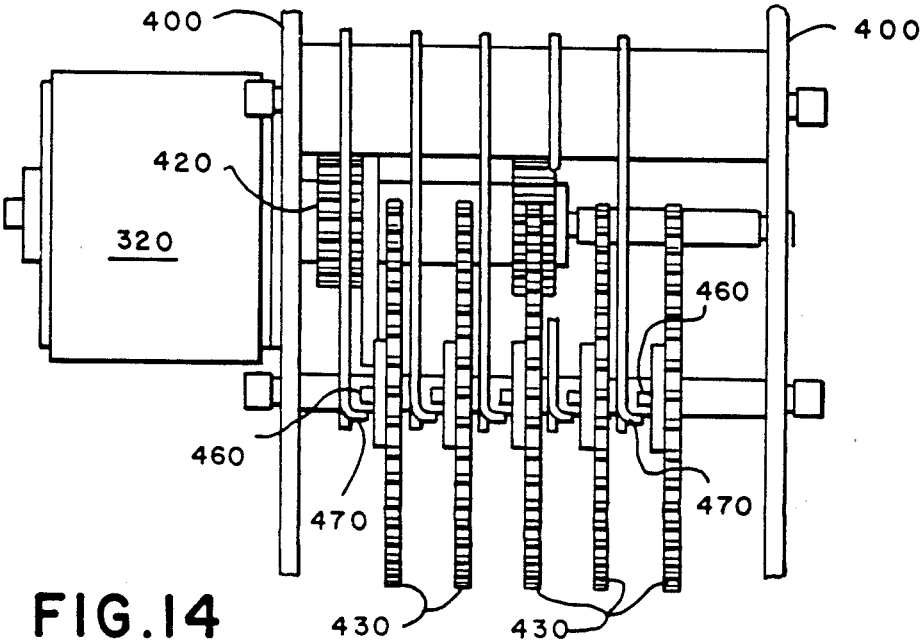
FIG. 14 is a section taken along the line 14—14 of FIG. 11.

FIG. 10 is a flow chart for the releasing of the deadbolt 42 to allow the shutter to be retracted. Once it has been determined that the meter is on an appropriate base, the solenoid is actuated for a predetermined amount of time to allow the operator to move the shutter.

FIGS. 11–14 show the printwheel setting mechanism. The printwheel setting mechanism comprises five motor driven gear trains. Five stepper motors (each designated 320 since the drive trains are similar for each printwheel) are mounted on walls 400 each motor respective motor pinions 410, encoder assembly gears 420, transfer gears 430, and printwheel gears 440 attached to the printwheels 310. Each gear train includes a two-channel encoder sensor assembly designated herein as 480. The encoder assembly gears 420 include ten (10)-tooth gears which mesh with the transfer gears 430 and twenty (20)-tooth gears that mesh with the motor pinions 410 along with the planar wheel portions which extend into the sensor assemblies 480.

Each sensor channel comprises a source, suitably an infrared-emitting diode and a detector, a photodiode with its associated circuity.

The encoder wheel shown operates to produce ten (10) transitions per revolution as the encoder wheel passes through the sensor assembly and in each sensor channel alternately blocks and unblocks the radiation from the source. This results in two (2) sensor detector transitions (one for each channel of the two-channel sensor) for each move of one-digit.

The channels as illustrated are physically separated such that as the encoder wheel rotates, the detector outputs are in phase quadrature (the output of one of the two detectors leads or lags the output of the other detectors by one quarter of a cycle).

The motor pinions 410 are twelve (12)-tooth gears affixed to the motor shafts and mesh with the twenty (20)-tooth gears of the encoder gear 420.

In the illustrated embodiment, the stepper motors 320 turn through a complete revolution in 24 steps which, as transmitted through the gear train previously described, require 4 motor steps for movement of one digit of the printwheel. In this embodiment, the stepper motors are four-phase motors preferably driven by the drivers in a two-phase mode. The motor control sequence is discussed below in conjunction with the flow charts of figures for the printwheel setting.

Each printwheel 320 forms a substrate for the molded print characters arranged around the periphery of the wheel, one of which is designated 450. The printwheel also comprises ten (10)-tooth printwheel gear 440 which is used also as described below for alignment of the printwheel when printing takes place.

The transfer gears 430 are thirty (30)-tooth gears that mesh with the printwheels gears 440 and the ten (10)-tooth gears of the encoder gears 420. The transfer gears 430 include a protrusion 460 which in conjunction with a fixed feature 470 on the housing provides an end stop or zero-reference position for the mechanism.

When the transfer gear protrusion 460 is adjacent the stop 470 that there is a known fixed value on the print die plane. It will be appreciated that with thirty (30)-teeth on the transfer gear meshing with the ten (10)-teeth on the printwheel gear there will be three (3) rotations of the printwheels for one rotation of the transfer gear. Because of the particular implementation of the end stop, there are in this embodiment twenty-six (26) transfer gear positions which correspond to the 10 digit position of the printwheel.

In the embodiment shown, a single solenoid 450 raises die protector blades 460 in tandem to enable the printing of postage. While this arrangement normally works well in conventional flat bed printers, there is further provided in the postage meter in accordance with the present invention further die protection as shown more particularly in conjunction with FIGS. 15 and 16.

Figure 15:
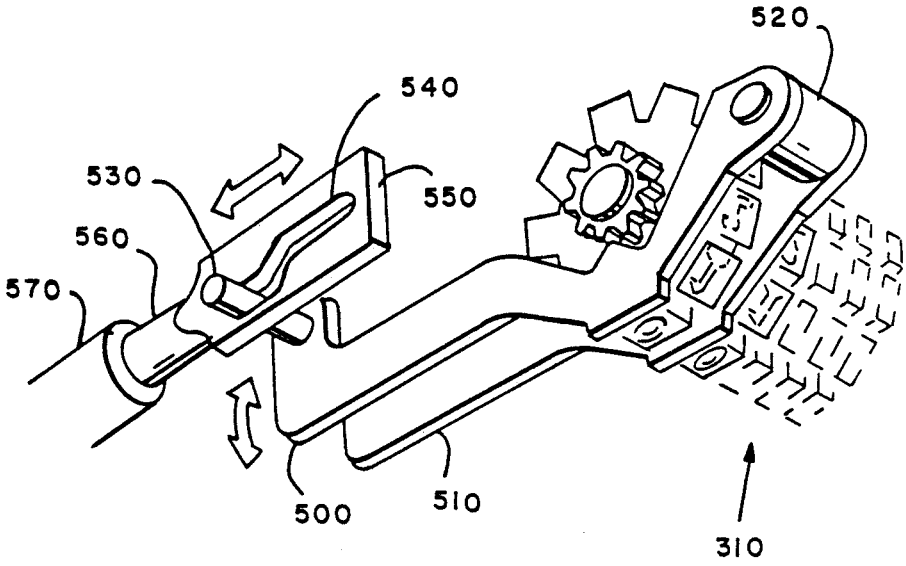
FIG. 15 is an embodiment of a die protector arrangement in which the die protectors are disposed adjacent to the higher order printwheels.

FIG. 15 is a perspective view of the die protector mechanism. In accordance with the present invention, two die protector blades 500 and 510 are placed adjacent to the two highest order printwheels of the printwheel banks 310. When the meter is logically incapable of accepting a print request, these two blades protrude beyond the printing plane of the print elements to prevent the "wiping" of fraudulent prints from the die.

Particular conditions under which, for example, the meter may be disabled include lack of power, insufficient funds, value selection in progress in which the higher order printwheels are to be moved, and various sensed error conditions.

As is shown in FIG. 15, blades 500 and 510 are pivotally attached at shaft 520 and at the opposite end are engaged via pin 530 which is held in S-shaped slot 540 of member 550 to the armature 560 of solenoid 570. The solenoid 570 is under the direct control of the microprocessor. When the solenoid is energized it pulls in the member 550 against the force of a spring (not shown) and the elevated portion of slot 540 raises the die protector blades. The die protector blades will remain retracted until the microprocessor de-energizes the solenoid or until power is lost.

When the die protector blades are retracted, they perform the alternate function of detenting the two higher order print wheels to improve their alignment.

Figure 16:
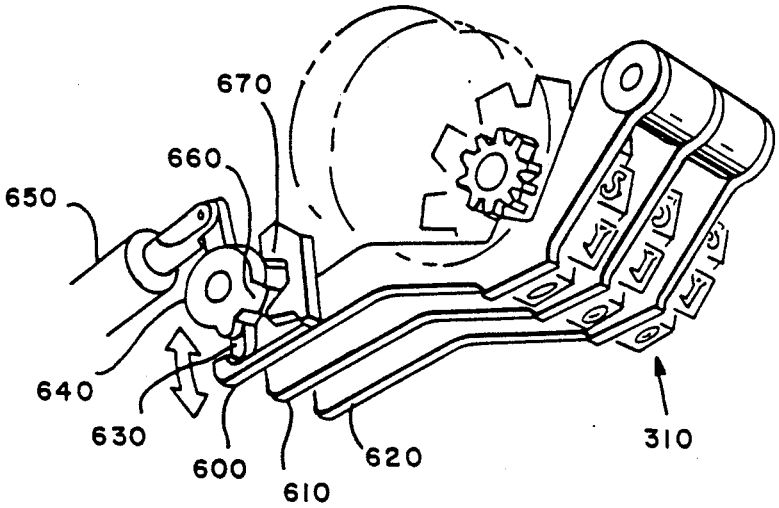
FIG. 16 shows an embodiment wherein there is an aligner/protector mechanism for the lower order printwheels.

FIG. 16 shows an additional die protector mechanism which comprise a set of protruding die protector blades which are retracted for only a brief interval during each print operation. Preferably this retraction coincides with the meter accounting operation. In accordance with the invention, these die protector blades shown at 600, 610, and 620 are disposed next to the lower order printwheels. The three blades are normally locked in position as shown suitably by projecting tooth 630 of rotatable cam 640. Solenoid 650 when actuated rotates cam 640 to move tooth 630 out of the way and to raise the die protectors by engagement of the tooth 660 on cam 640 with tooth 670 on the die protector blades. The rotation of cam 640 is also against a spring (not shown) so that in the event of failure the cam will return to the locked position.

It will be appreciated that the actuation of these two types of die protection may be by way of either type of mechanism described herein and is not limited to either method so long as the locking is achieved.

For operation, the three blades are normally locked in the protruding position and external forces cannot cause them to retract. When the mailing machine communicates a request to print an imprint, the meter will consider the request and on the basis of availability of funds and other printing criteria, and if accepted will energize the solenoid and withdraw the aligner/protectors for a timed period in which the mailing machine can ink the die and take the print. Preferably, the aligner/protectors have the auxiliary function of detenting and aligning the lower order printwheels.

Figure 17:
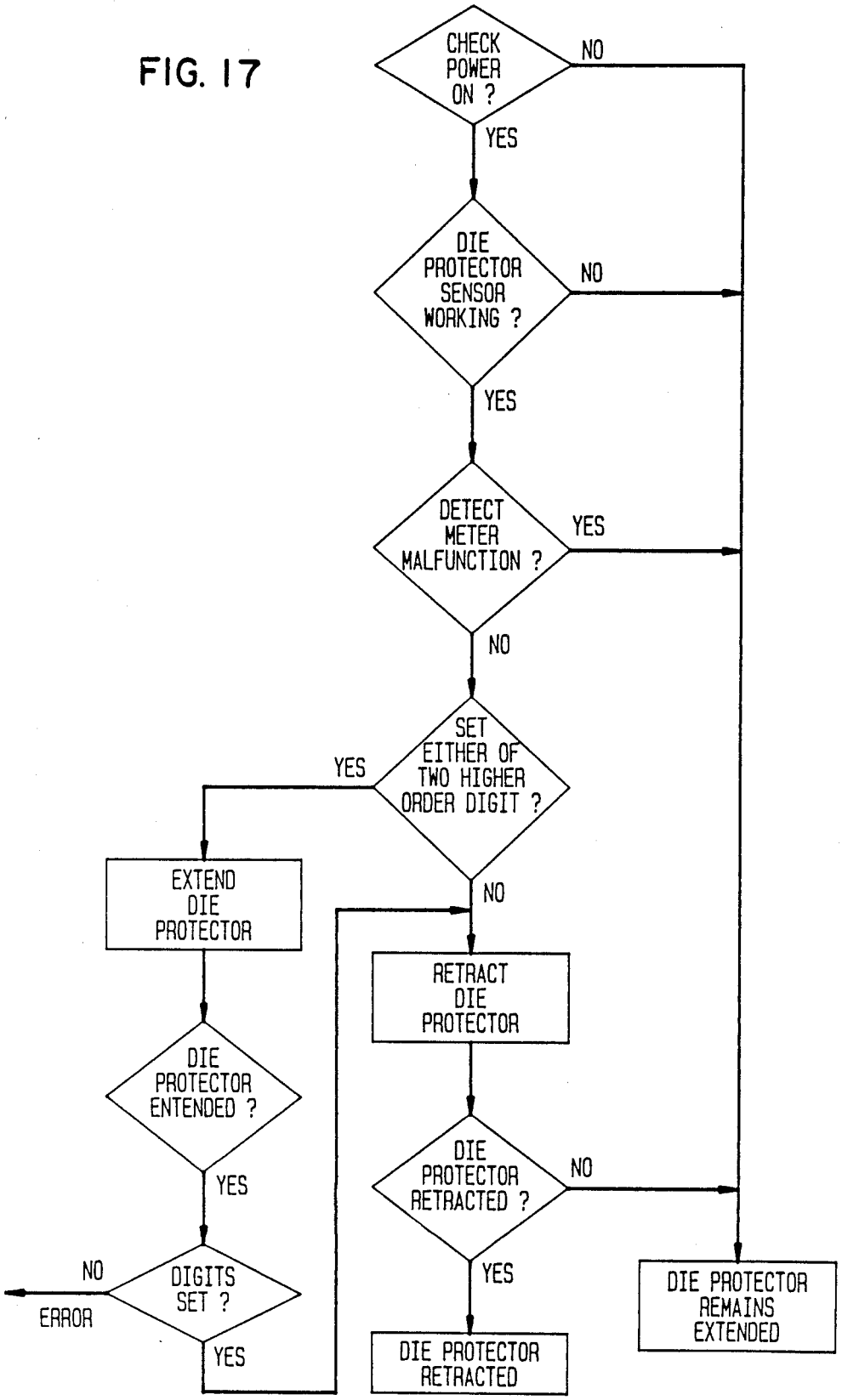
FIG. 17 is a flow chart for the operation of the die protector blades for the higher order printwheels.
Figure 18:
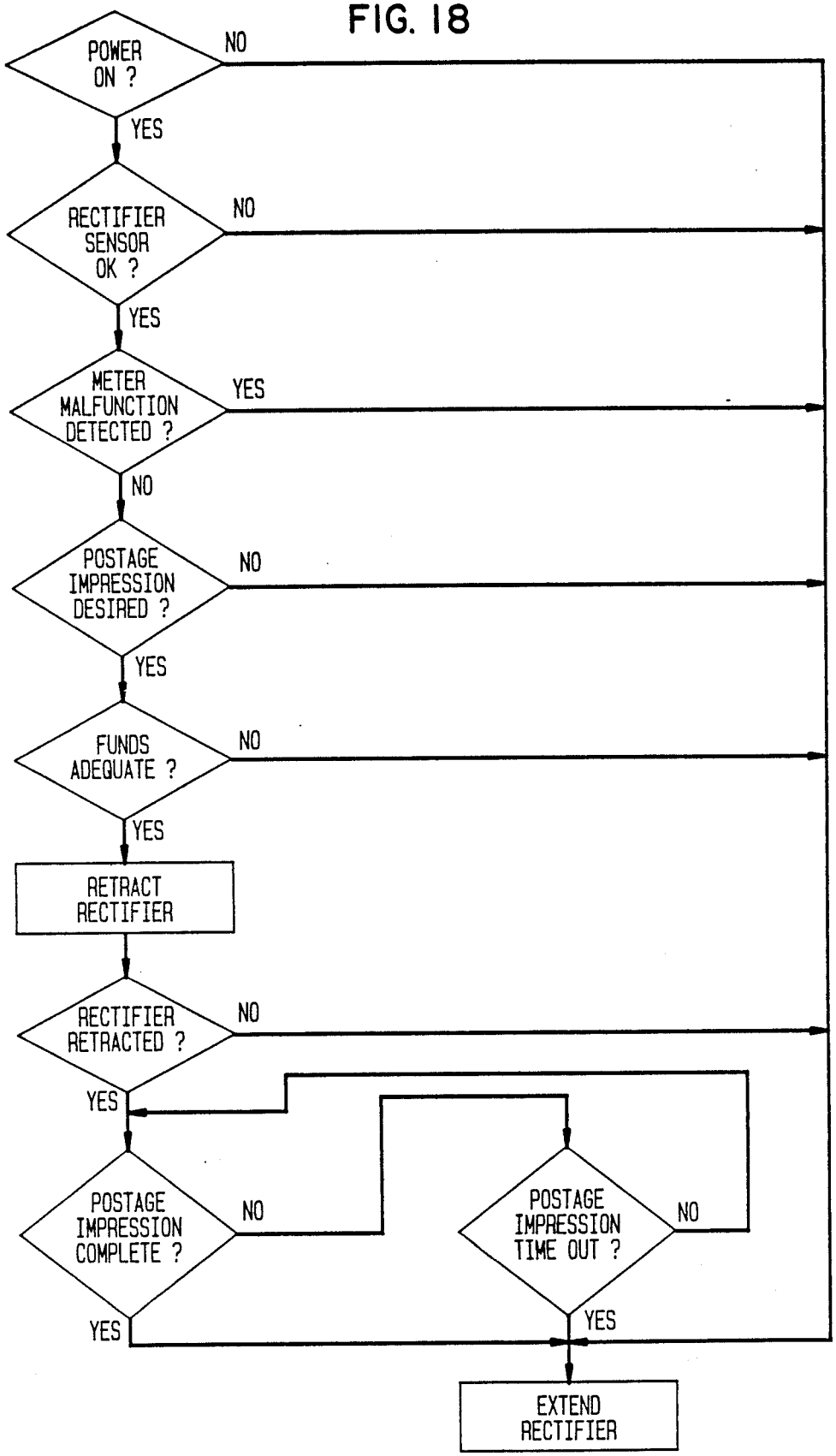
FIG. 18 is a flow chart for the operation of the aligner/protector blades.

FIGS. 17 and 18 are flow charts for the operation of the die protector and the aligner/protector mechanisms. The operation of each has been described and it is not believed to be necessary to describe the flow charts in any greater detail.

FIGS. 19A–19H show the operation of the print wheel setting mechanism shown and described in conjunction with FIGS. 11–14. The flow chart shows the operation of the mechanism to enable advantage to be taken of the shortest path to the new setting. This is of great benefit to the increased setting speed required for the throughput of a meter in accordance with the invention for minimizing power comsumption.

Figure 19A:
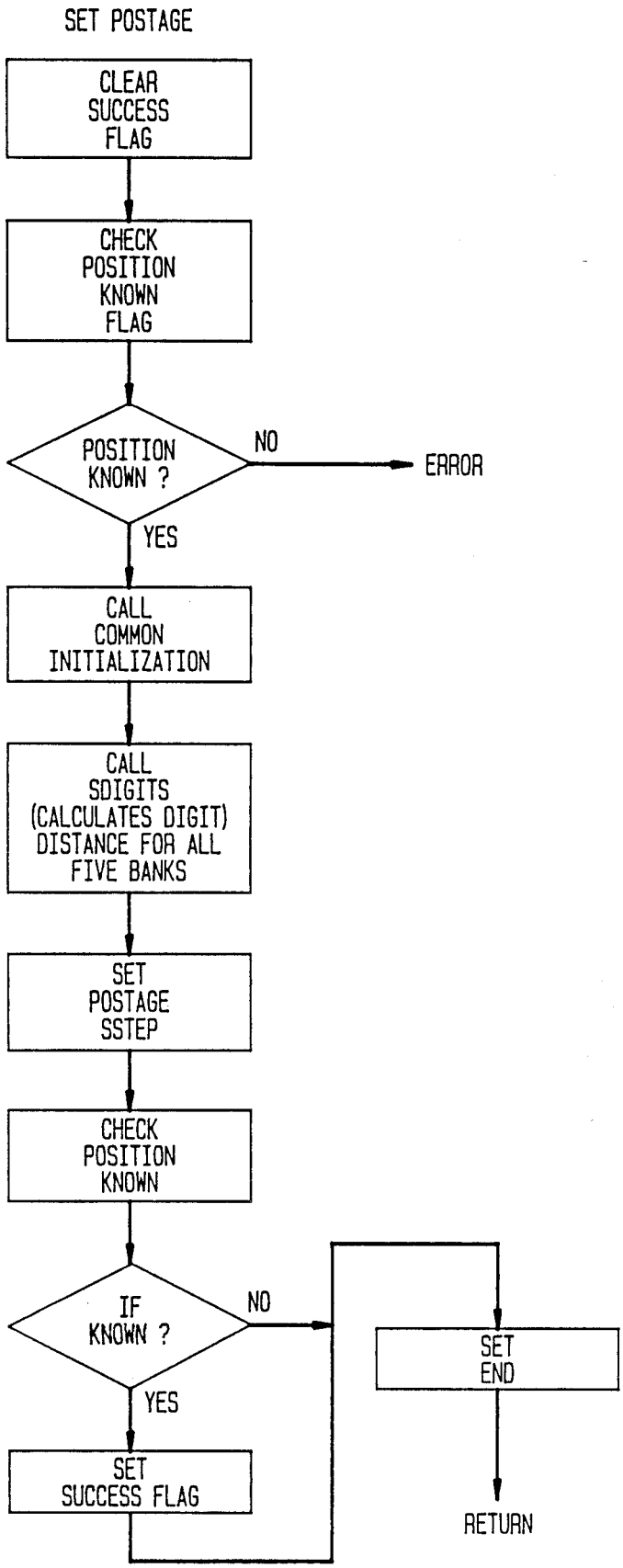
FIGS. 19A–19H comprise a flow chart for the operation of the printwheel setting mechanism.

FIG. 19A shows the normal set postage routine for setting the printwheels of the postage meter. In accordance with this routine, a success flag is first cleared and a flag indicating whether the position of the printwheels is known is checked. If the position-known flag is set, a software initialization routine is called. A subroutine SDIGITS calculates the digit distance for all five banks of printwheels and when this calculation is complete a set postage routine, SSTEP, is called. At the end of the setting routine, the position is again checked and if it is known the success flag is set.

Figure 19B:
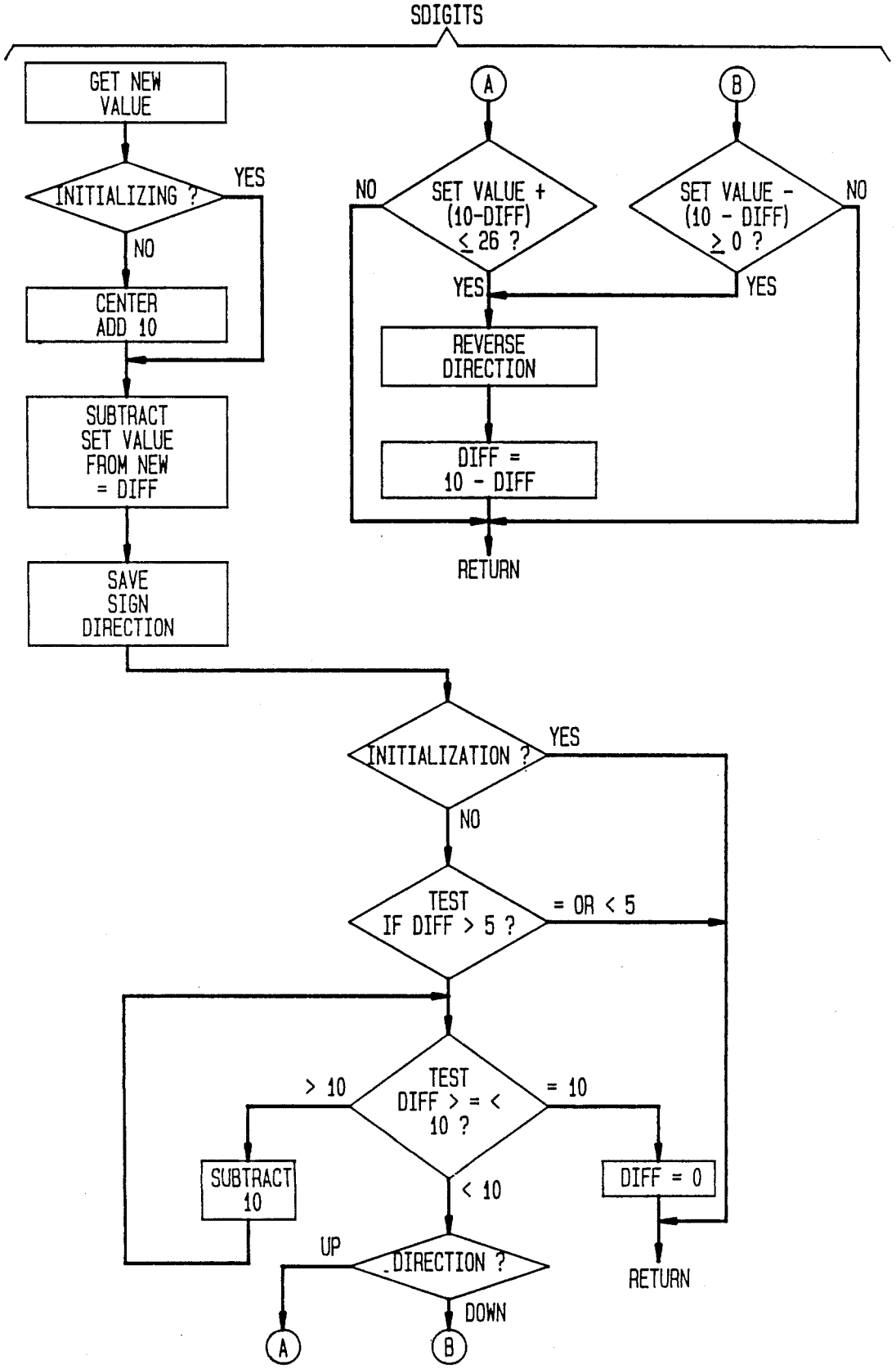

FIG. 19B shows the subroutine SDIGITS which computes the distance and direction that each digit wheel must move by subtracting the value of postage currently set, stored as old value from the desired value stored as new value. As mentioned in the discussion of FIGS. 11 through 14, each printwheel character printing position is associated with multiple transfer gear setting positions. Thus in accordance with the routine, except when the meter setting mechanism is being initialized, ten (10) is added to the new digit to place the new number in the center decade of the transfer wheel. The value presently set in the printwheel is subtracted from the new value thus obtained to get the difference (DIFF). The sign resulting from the subtraction is also stored to determine the direction the printwheels must move.

A test is then made as to whether initialization is being done. If yes, the routine returns to the main loop. If initialization is not being done, the DIFF is tested to see whether it is greater than five (5). If DIFF is equal to or less than five (5) the program returns to the main loop. If the outcome of a test shows that the difference is greater than five (5), DIFF is tested again for being greater than, equal to, or less than ten (10). If the outcome is equal to ten (10), DIFF is made equal to zero (0) and the program returns to the main loop. If greater than ten (10), ten (10) is subtracted from the difference and the result is again tested. If DIFF then is less than ten (10), the direction is tested to see whether the printwheels are to move up or down.

If the wheel is to move up, the set value plus (ten minus DIFF) is tested and if less than or equal to twenty-six (26), the direction is reversed and DIFF is set equal to ten (10) minus DIFF. If no, the program returns to the main loop.

If the printwheel direction is down, then set value minus (10 minus DIFF) is tested as being greater than or equal to zero (0) and if it is then direction is reversed and DIFF is set equal to ten (10) minus DIFF. If no, the program returns to the main loop.

Figure 19C:
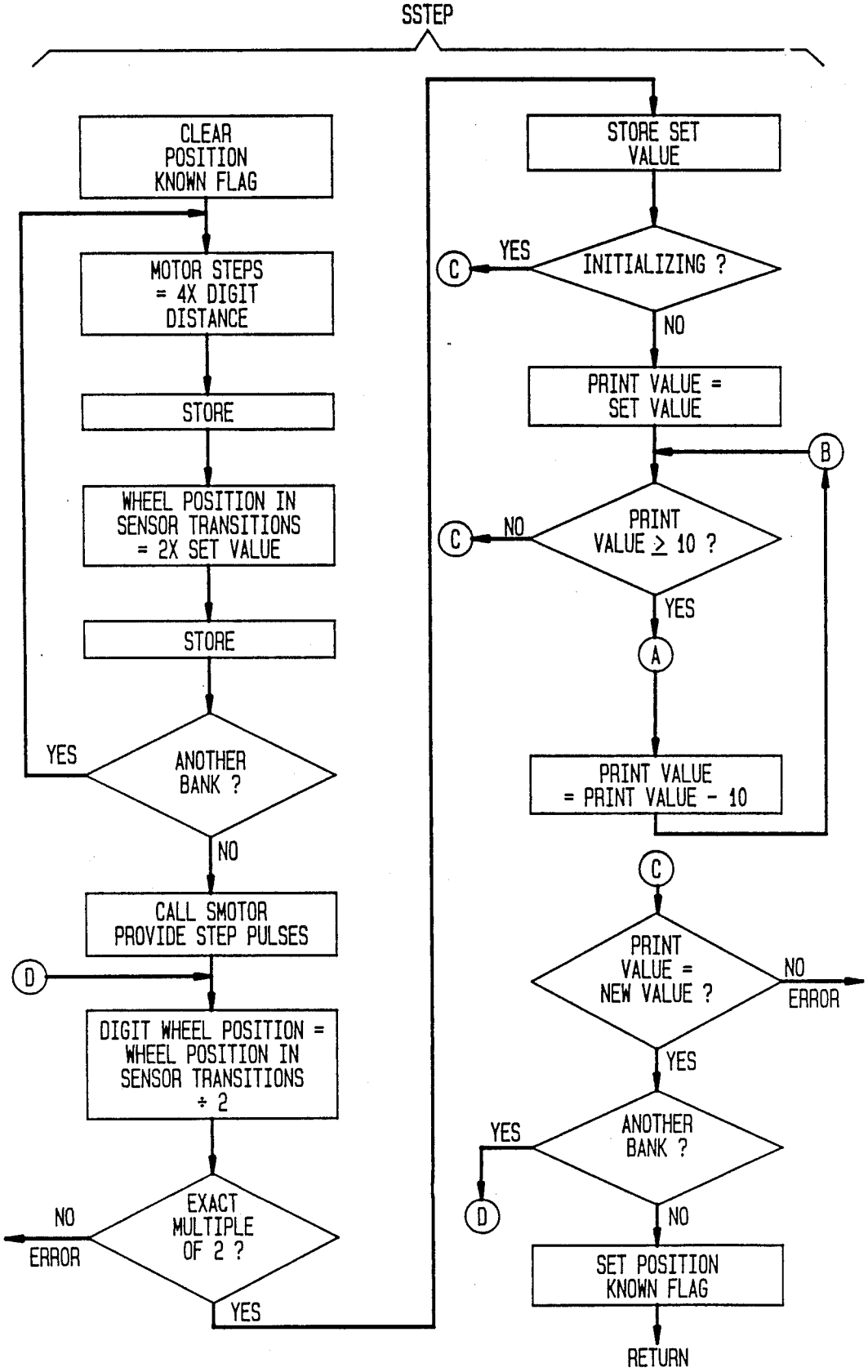

FIG. 19C shows the subroutine SSTEP. This subroutine will move the printing wheels by the number of digits specified in the SDIGITS program and in the direction specified in that subroutine. In this subroutine, the position known flag is cleared and the number of motor steps required are calculated by multiplying the digit distance by four (4) since the stepper motor moves four (4) steps for each digit. The wheel position in sensor transition is also calculated as two (2) times the set value. This is determined for each bank. At this juncture, the subroutine SMOTOR is called to provide the step pulses to the stepper motor to drive the printwheels. The digit wheel position is calculated from the wheel position in sensor transitions which have been kept updated through the move, divided by two (2), since as mentioned previously there are two (2) sensor transitions per digit. The calculation is checked to see if its an exact multiple of two (2) and if not, an error routine is called. If yes, the set value is stored. A routine then follows to check whether the setting is initializing and if not, the print value is set equal to the set value. The print value is checked to determine whether it is greater than or equal to ten (10), if it is, the print value is made equal to the print value minus ten (10) and again checked.

If the print value is less than ten (10), the routine proceeds to check whether the print value now equals the new value and if not, an error routine is called. If the answer is yes, the subroutine determines if there are any remaining banks to be set. If there are, the wheel position for the next bank is checked until no banks remain to be checked. The position known flag is set before returning.

Figure 19D:
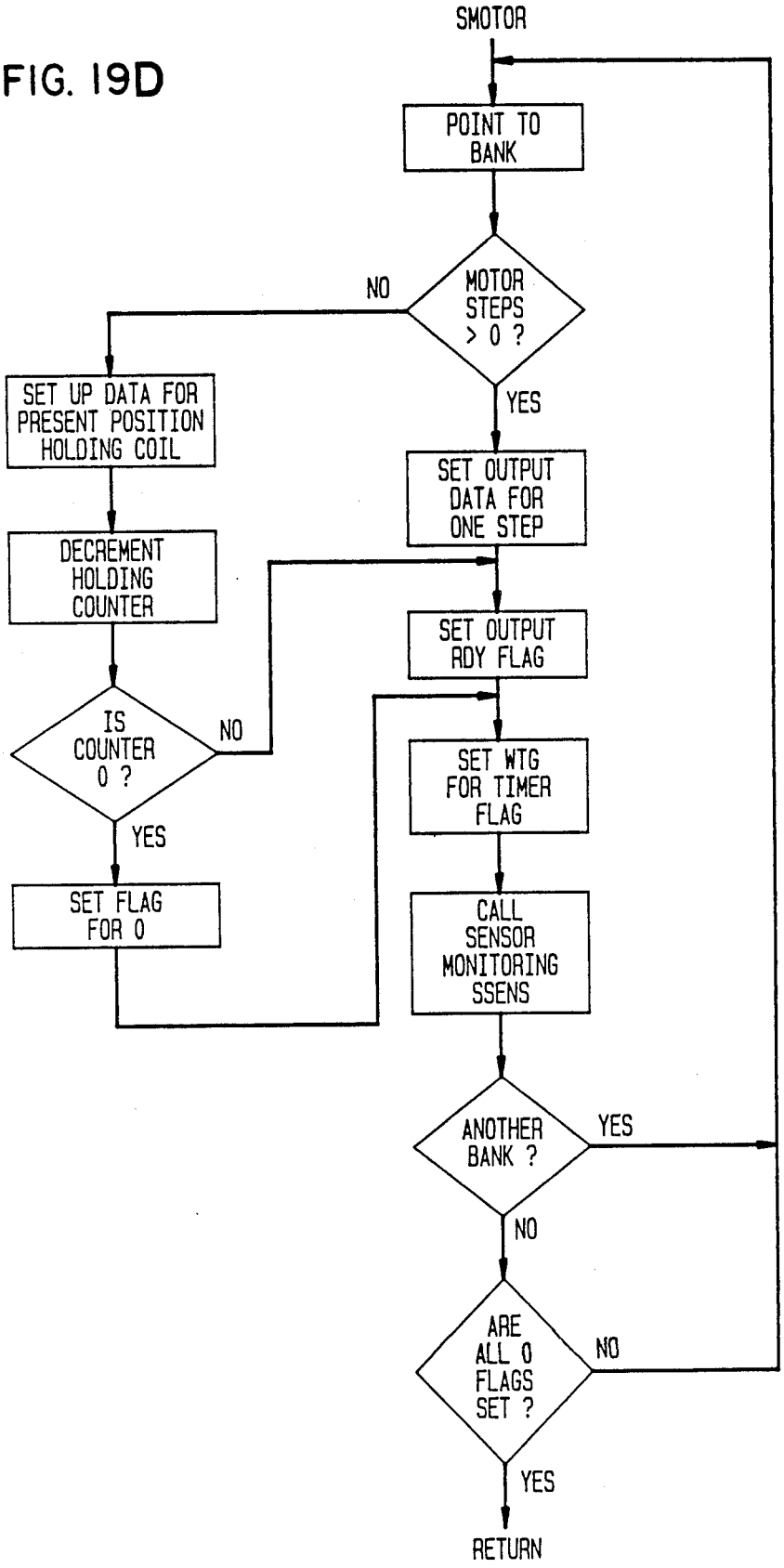

FIG. 19D shows the subroutine SMOTOR for providing step pulses to each motor. Each motor is provided output on a sequential basis during the setting cycle for the printwheel banks. For each bank then the motor steps are checked and if they are greater than zero (0) then an output is set for the motor to move one (1) step and an "output ready" flag and "waiting for timer" flag are set. The sensor monitoring routine SSENDS is called and a check is made as to whether another bank is required to be set.

If at the check for motor steps, the bank shows zero (0) steps to do, the program branches to set up data for present position holding coil and a holding counter is decremented. If the counter has not reached zero (0) the program returns to the main loop of SMOTOR and the "output ready" flag and "waiting for timer" flags are set and the sensor monitoring routine is again called. If the counter has decremented to zero (0), then the flag is set for zero (0) and the "waiting for timer" flag is set with no "output ready" flag. The program operates until all the zero (0) flags are set at which point it returns to the main loop.

Figure 19E:
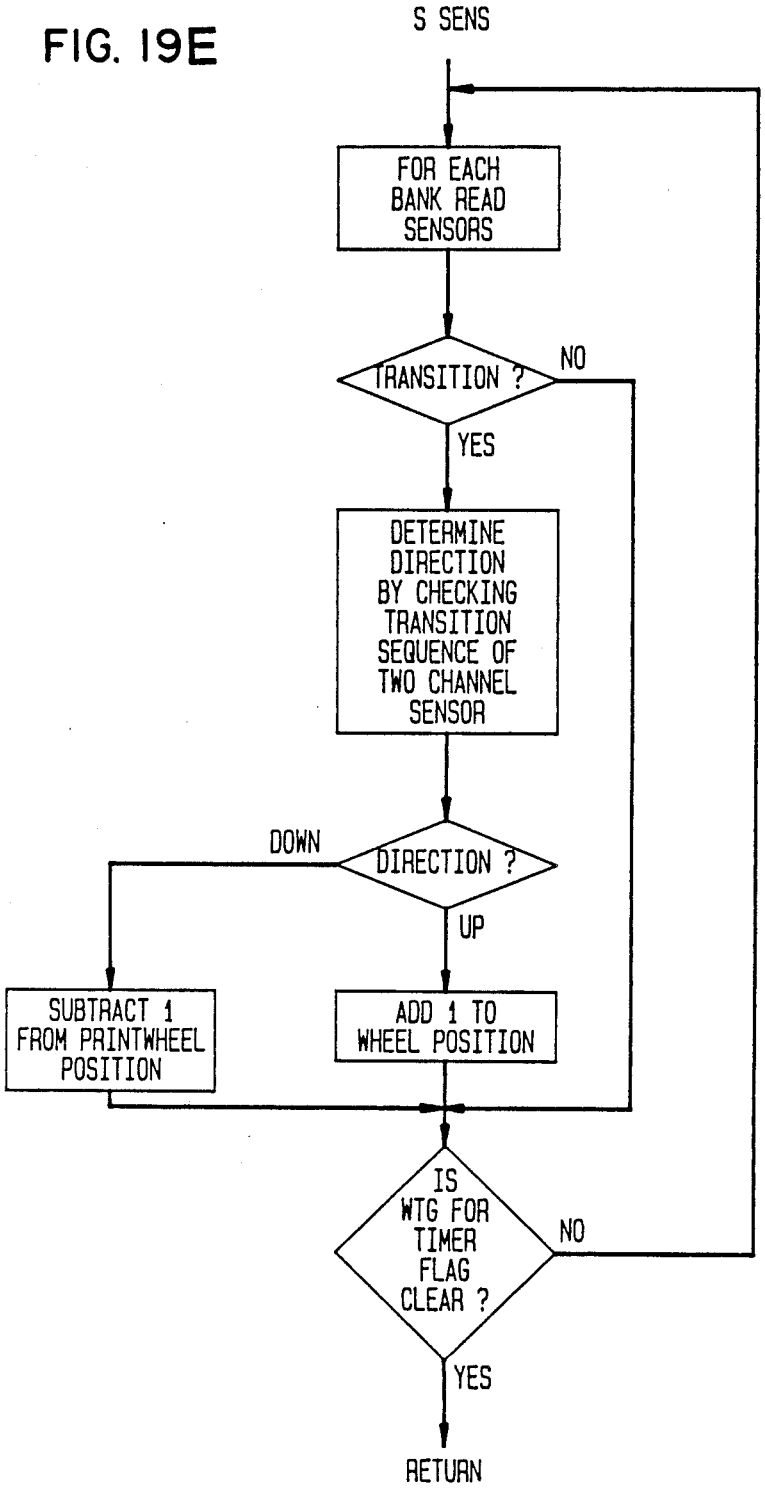

FIG. 19E shows the subroutine SSENDS which monitors the sensor channels to update the actual positions of the wheel. In this subroutine, each bank sensor is read and it is determined whether a transition has been made. If the answer is yes, the direction is determined by checking the transition sequence of the two channel sensor and if the direction is down, one is subtracted from the wheel position and if the direction is up, one is added to the wheel position. At this point the "waiting for timer" flag is checked and if it is clear the program returns. If the waiting for timer flag is not cleared then the next bank is read.

If no transitions were detected then the "waiting for timer" flag clear is checked. And if cleared, the program returns.

Figure 19F:
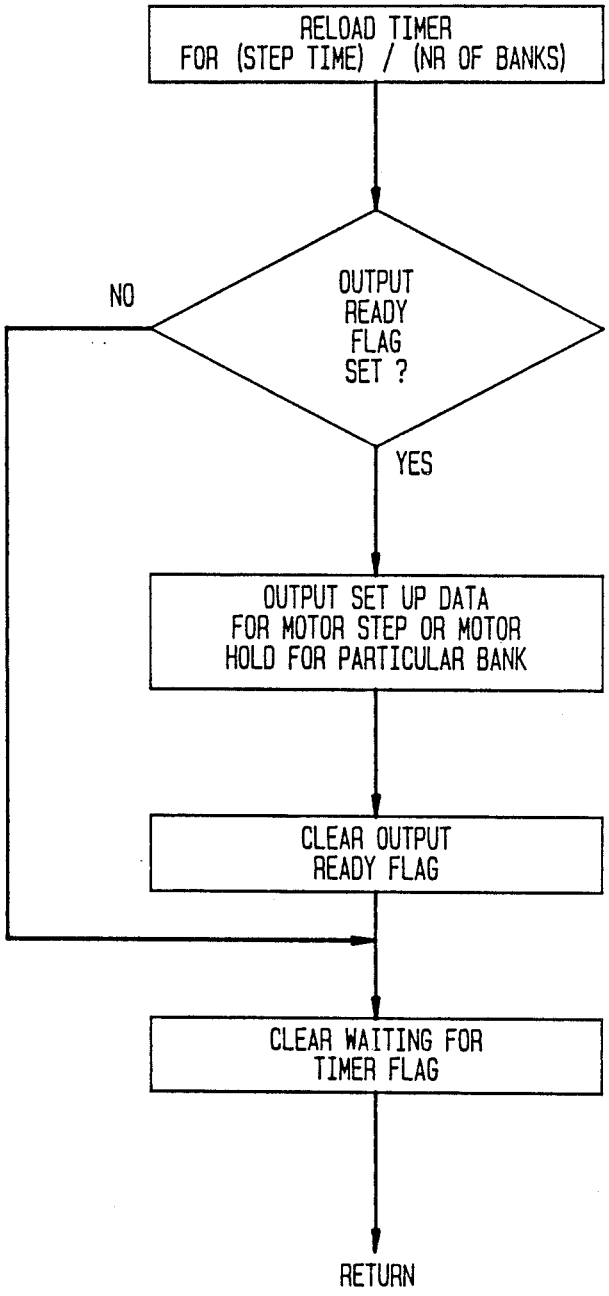

FIG. 19F shows the timer interrupt routine.

Figures 19G, 19H:
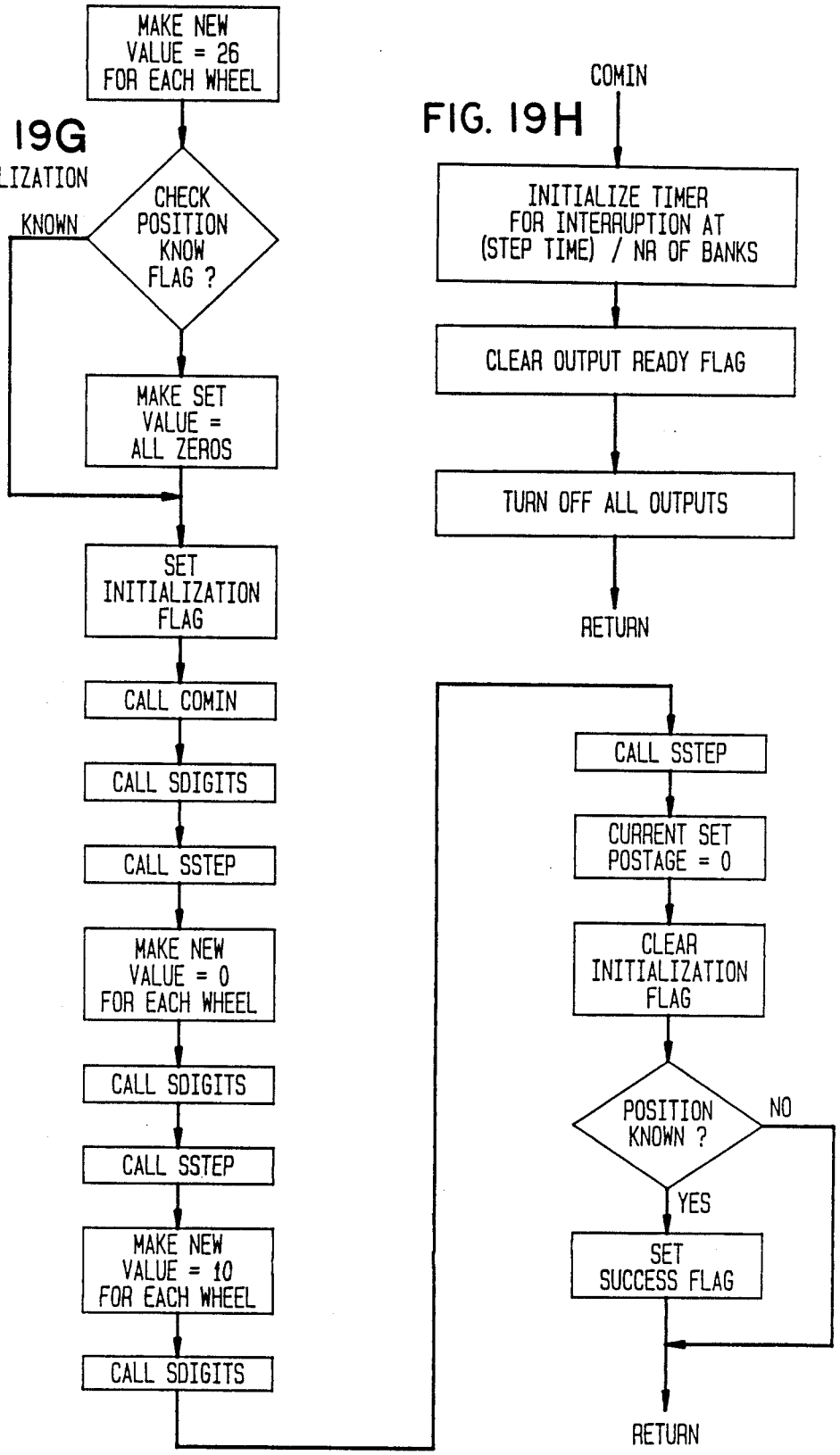

FIG. 19G shows the subroutine for initializing the printwheels. In this routine, the new value is set equal to twenty-six (26) for each wheel and the transfer gear is driven all the way to the stop. At this point, the "position known" flag is checked and if the "position known" flag is not set, the set value is set equal to all zeros (0's). If the position known flag is set, the step of making all zeros (0's) is skipped.

The initialization flag is then set, the common initialization routine is called and the subroutine proceeds to check the printwheel positions at the middle and opposite end. At this point, the current set postage is set equal to zero (0) and the position known is tested and if the position is known, the success flag is set. If not, the success flag is not set and in both instances the program returns to the main loop.

FIG. 19H shows COMIN, the subroutine for common initialization. This routine is common to all motor hardware drivers and it initializes the registers and sets up the timer for interruption at predetermined times.

It is believed that the flow chart is easily followed by anyone skilled in the art and that it is not necessary to go into any discussion of the routines.

What is claimed is:

1. A printwheel setting device for positioning a printwheel of a postage meter comprising:

a printwheel having a plurality of printing characters about the periphery thereof;

a motor;

a gear train drivingly connecting said motor to said printwheel;

said gear train including at least one gear such that a plurality of positions of said at least one gear correspond respectively to a printing position of each of the plurality of printing characters on said printwheel;

means for determining the path of rotation of said at least one gear to a nearest one of said plurality of positions to place said at least one gear into a position wherein a desired character on said printwheel is in the printing position; and means for operating said motor to move said at least one gear wheel to said position.

2. The setting device of claim 1 wherein said means for determining the shortest rotation path is operative to tend to place said at least one gear wheel in the mid-range of its rotation.

3. The setting device of claim 1 further comprising encoding means for enabling determination of the position of said at least one gear wheel.

4. The setting device of claim 3 wherein said encoding means includes a two-channel sensor arrangement whereby the direction of rotation can be determined.

5. The setting device of claim 3 further comprising a stop on said at least one gear, said stop cooperating with a fixed point on the postage meter to determine a known value for the printwheel and from which point other printwheel positions may be calculated from information provided by said encoding means.

6. The setting device of claim 1 wherein said motor is a stepper motor.

7. In a postage meter of the type having a printing die carrying an indicia and printwheels for the printing of postal value, means for setting said printwheels comprising:

a plurality of printwheels each having respective printwheels gears connected thereto;

a plurality of stepper motors having respective stepper motors shafts, each stepper motor being respectively associated with one of said printwheels;

each said stepper motor shaft having a pinion carried thereon;

a plurality of transfer gears, each respectively meshing with said printwheel gears;

gear means respectively connecting said transfer gears and said pinions for driving said printwheels to a desired position;

said transfer gears having a greater number of teeth than said printwheel gears wherein a predetermined position of the printwheel gears are associated with a plurality of positions of the respective transfer gears;

means for determining the rotation path for the rotation of each transfer bear to a nearest one of said plurality of positions to place the printwheel in a desired position; and means for driving said stepper motor as required to rotate said transfer gear and thereby said printwheels to said desired position.

8. The setting means of claim 7 further comprising encoding means for enabling determination of the position of each printwheel.

9. The setting means of claim 8 wherein said gear means connecting said transfer gears and said pinions comprises a part of the encoder means, said encoder means further including sensor channels which are blocked and unblocked by rotation of the connecting gear means.

10. The setting means of claim 9 wherein the encoder sensors are two-channel sensors for providing phase information from which the direction of rotation may be determined.

* * * * *